US009997874B2

(12) United States Patent
Oed et al.

(10) Patent No.: US 9,997,874 B2
(45) Date of Patent: Jun. 12, 2018

(54) ELECTRICAL CONNECTION

(71) Applicant: CONTI TEMIC MICROELECTRONIC GMBH, Nuremberg (DE)

(72) Inventors: Harald Oed, Nuremberg (DE); Marcus Ulherr, Schwarzenbruck (DE); Matthias Wieczorek, Neunkirchen am Sand (DE)

(73) Assignee: Conti Temic microelectronic GmbH, Nuremberg (DE)

( * ) Notice: Subject to any disclaimer, the term of this patent is extended or adjusted under 35 U.S.C. 154(b) by 0 days. days.

(21) Appl. No.: 15/031,882

(22) PCT Filed: Oct. 16, 2014

(86) PCT No.: PCT/EP2014/072251
§ 371 (c)(1),
(2) Date: Apr. 25, 2016

(87) PCT Pub. No.: WO2015/059033
PCT Pub. Date: Apr. 30, 2015

(65) Prior Publication Data

US 2016/0268743 A1 Sep. 15, 2016

(30) Foreign Application Priority Data

Oct. 23, 2013 (DE) ..... 10 2013 221 454

(51) Int. Cl.
*H01R 24/28* (2011.01)
*H01R 13/52* (2006.01)
(Continued)

(52) U.S. Cl.
CPC ..... *H01R 24/28* (2013.01); *H01R 13/5202* (2013.01); *H01R 13/5219* (2013.01); *H01R 13/621* (2013.01); *H01R 13/748* (2013.01)

(58) Field of Classification Search
CPC ..... H01R 24/28; H01R 13/6215
(Continued)

(56) References Cited

U.S. PATENT DOCUMENTS 4,705,339 A * 11/1987 Hayes ..... H01R 13/432 439/277
4,767,350 A * 8/1988 Cooper ..... H01R 12/716 439/271
(Continued)

FOREIGN PATENT DOCUMENTS

DE 3728456 A1 3/1989
DE 4228818 A1 3/1994
(Continued)

*Primary Examiner* — Tulsidas C Patel
*Assistant Examiner* — Marcus Harcum
(74) *Attorney, Agent, or Firm* — Laurence A. Greenberg; Werner H. Stemer; Ralph E. Locher

(57) ABSTRACT

An electrical connection is formed of a plug outside a housing and a circuit carrier inside the housing. The plug includes at least one plug contact and an end face in the direction of the housing wall. The circuit carrier includes a receptacle for a plug contact. The plug contact protrudes through an opening in the housing wall in order to establish the electrical connection. The cross-sectional surface of the opening is smaller than the end face of the plug, the end face completely covers the opening and the circuit carrier at least partially covers the opening.

10 Claims, 3 Drawing Sheets

(51) Int. Cl.
*H01R 13/621* (2006.01)
*H01R 13/74* (2006.01)

(58) Field of Classification Search
USPC ..... 439/76.1, 271, 147, 374
See application file for complete search history.

(56) References Cited

U.S. PATENT DOCUMENTS 5,641,313 A * 6/1997 Hohorst ..... H01R 9/2658 439/709
5,909,496 A * 6/1999 Kishigami ..... H04R 1/005 381/111
6,059,594 A * 5/2000 Davis ..... H01R 13/5205 439/275
6,515,228 B2 * 2/2003 Albert ..... B60R 16/0239 174/525
6,521,830 B1 2/2003 Platz
6,831,822 B2 12/2004 Berberich
7,128,582 B2 * 10/2006 Fang ..... H01R 13/514 439/362
8,092,234 B2 * 1/2012 Friedhof ..... H01R 13/6633 439/76.1
8,523,581 B2 * 9/2013 Martin ..... H01R 12/724 439/83
9,190,767 B2 * 11/2015 Makimura ..... H01R 13/5219
2001/0027037 A1 * 10/2001 Kuo ..... H01R 13/6215 439/76.1
2006/0019512 A1 * 1/2006 Kent ..... H01R 13/6658 439/76.1
2007/0202733 A1 * 8/2007 Rose ..... H01R 13/6215 439/362
2007/0212918 A1 * 9/2007 Gruebel ..... H01R 13/4538 439/271
2012/0021631 A1 * 1/2012 Yi ..... H01R 13/5202 439/271
2012/0322285 A1 * 12/2012 Homme ..... H01R 13/502 439/271
2013/0203277 A1 * 8/2013 Gaubert ..... H01R 13/6277 439/271
2013/0244512 A1 9/2013 Endo et al.
2015/0126055 A1 5/2015 Morita

FOREIGN PATENT DOCUMENTS

DE 19516936 A1 11/1996
DE 19755767 A1 6/1999
DE 19944383 A1 4/2001
DE 102005054601 A1 5/2007
DE 102005054601 B4 6/2008
JP S6180765 A 4/1986
JP 2002141147 A 5/2002
JP 2003531501 A 10/2003
JP 2007066592 A 3/2007
JP 2013048018 A 3/2013
JP 5307277 B1 10/2013
WO 0182670 A1 11/2001

* cited by examiner

PRIOR ART

ELECTRICAL CONNECTION

BACKGROUND OF THE INVENTION

Field of the Invention

The invention relates to an electrical connection between a plug outside a housing and a circuit carrier within the housing, wherein the plug includes at least one plug contact and has an end face in the direction of the housing wall, the circuit carrier includes a receptacle for a plug contact, and the plug contact protrudes through an opening in the housing wall in order to establish the electrical connection. The invention also relates to a method for establishing a connection of this kind.

The invention relates to the field of electrical plug connections for establishing an electrical connection between two electrical regions which are separated from one another by a wall. Electrical connections of this kind are used, for example, when using transmission controllers in motor vehicles, wherein the circuit carrier, on which a control unit is arranged for example, in the controller housing is electrically connected to electrical components outside the housing with the aid of a plug.

The plug is generally arranged directly on the circuit carrier or the printed circuit board. This ensures that the tolerance chains when establishing the connection are as short as possible. However, one disadvantage with this arrangement is that the opening in the housing wall has to be somewhat larger than the plug itself, this possibly leading to difficulties when sealing off the plug in relation to the housing wall. A further disadvantage with this arrangement is that the contact area between the housing inner wall and the circuit carrier, the size of which contact area determines, amongst other things, the degree of heat transfer from the circuit carrier to the housing, is relatively low under certain circumstances. At the same time, since the plug is in contact with the circuit carrier by way of at least its entire cross-sectional area, the surface area of the circuit carrier is relatively large, this having the effect of increasing costs in the case of a high-quality ceramic circuit carrier.

BRIEF SUMMARY OF THE INVENTION

One object of the present invention is therefore to create an electrical connection between a plug and a circuit carrier of the kind mentioned in the introductory part, which electrical connection constitutes an improvement over the prior art in respect of complexity when sealing off the plug from the housing and in respect of reducing the size of the circuit carrier and therefore costs.

According to the invention, this object is achieved by an electrical connection having the features recited below.

In the case of the connection according to the invention between a plug outside a housing and a circuit carrier within the housing, the cross-sectional area of the opening in the housing wall through which a plug contact of the plug protrudes for establishing the electrical connection is smaller than the end face of the plug, wherein the end face of the plug completely covers the opening. The circuit carrier however at least partially covers the opening.

Since the end face of the plug completely covers the opening in the housing wall that side of the housing wall which faces the end face serves, in particular, as a stop for positioning the plug in a simple manner when establishing the connection. Furthermore, this arrangement advantageously makes it easier to seal off the plug in relation to the housing. For example, a seal which is designed as a seal ring can be provided, in particular, in a groove which runs around the end face, said seal sealing off the plug, in particular in an oil-tight manner, from the housing wall in the axial direction after the connection according to the invention is established.

In an alternative embodiment for connection with an axially acting seal between the plug and the housing wall, the seal can act radially, in a manner in the direction transverse to the longitudinal axis of the plug, between the plug and a projection, which runs around the opening in the housing wall, on the outside of said housing wall. In this case, this projection can be designed as a separate part or, in particular, also can be integrated in the housing wall. A feasible seal is a solid seal, for example a seal ring which is composed of plastic, but also a liquid seal.

Electrical components, such as processors or power semiconductors for example, which produce heat during operation are generally arranged on the circuit carrier. The contact area between the circuit carrier and the housing inner wall serves, in particular, firstly as a stop for positioning the circuit carrier on the housing wall in a simple manner and secondly for dissipating heat from the circuit carrier to the housing when establishing the connection according to the invention.

Since the cross-sectional area of the opening in the housing wall is smaller than the end face of the plug, the contact area between the housing inner wall and the circuit carrier, primarily in the case in which the circuit carrier completely covers the opening, is comparatively larger than in the case of an arrangement in which the plug is directly connected to the circuit carrier. This leads, in particular, to a comparatively increased level of transportation of heat from the circuit carrier to the housing.

An additional advantage in this case is that this also leads, in particular, to a comparative reduction in the area of the circuit carrier and therefore to a cost saving, primarily in the case of expensive ceramic circuit carriers. However, in the case of the connection according to the invention, it is not absolutely necessary for the circuit carrier to completely cover the opening, however it is necessary to ensure that the electrical connection between the plug contact of the plug and the corresponding receptacle in the circuit carrier is established.

The circuit carrier is connected in a force-locking or form-locking manner to the plug, in particular by means of screws or rivets.

The connection of a connection contact to the corresponding receptacle in the circuit carrier is advantageously designed as a so-called press-fit contact. A press-fit contact is a press-in connection and is established by pressing a connection contact, which is generally designed as a pin, into a receptacle which is designed as a plated-through circuit carrier or printed circuit board hole. It is critical here that the pin has a larger diagonal in cross section than the plated-through printed circuit board hole in diameter. This results in over-pressing when the pin is pressed into the receptacle, said over-pressing usually having to be absorbed by deformation of the pin. Owing to the elastic behavior of the pin, through-plating in the circuit carrier is subjected to less loading.

Furthermore, a greater hole tolerance of the plated-through bores in the circuit carrier is permissible and multiple pressing of connection contacts into the same printed circuit board bore is possible as a result.

In contrast to the conventional soldering technique, the press-fit technique has, in particular, the following advantages:

- no soldering, and therefore no thermal loading on the printed circuit board,
- no "cold" solder points,
- no short circuits due to solder bridges,
- long connection contact pins remain free of solder tin and can be used as a rear-side contact-making device,
- adjustable impedance of the connection due to a defined geometry, and therefore good RF properties,
- simple disassembly of the connection by purely mechanically pressing the pins out.

A further object of the present invention is that of providing a method for establishing an electrical connection between a plug and a circuit carrier of the kind mentioned in the introductory part in such a way that the connection constitutes an improvement over the prior art in respect of complexity when sealing off the plug from the housing and in respect of positioning the components involved in relation to one another.

According to the invention, this object is achieved by a method having the steps recited below.

In the method according to the invention for establishing a connection between a plug outside a housing and a circuit carrier within the housing, wherein the plug comprises at least one plug contact and has an end face in the direction of the housing wall, and furthermore the circuit carrier comprises a receptacle for a plug contact, and the cross-sectional area of the opening in the housing wall is smaller than the end face of the plug, the circuit carrier is initially positioned on the inside of the housing wall in such a way that the circuit carrier at least partially covers the opening in the housing wall.

The plug is then positioned on the outside of the housing wall in such a way that the end face of said plug completely covers the opening in the housing wall. A seal can be placed between the plug and the housing wall in the process. At the same time the connection between the plug contact of the plug and the corresponding receptacle in the circuit carrier is established in this case, in particular by means of a press-fit connection as already described.

As a result, the circuit carrier is connected to the plug in a force-locking or form-locking manner, in particular by means of a connection element such as a screw or a rivet.

BRIEF DESCRIPTION OF THE SEVERAL VIEWS OF THE DRAWING

Further features, advantages and details of the invention will be explained in greater detail below with reference to the exemplary embodiments which are illustrated in the appended drawings, in which.

DESCRIPTION OF THE INVENTION

Figure 1:
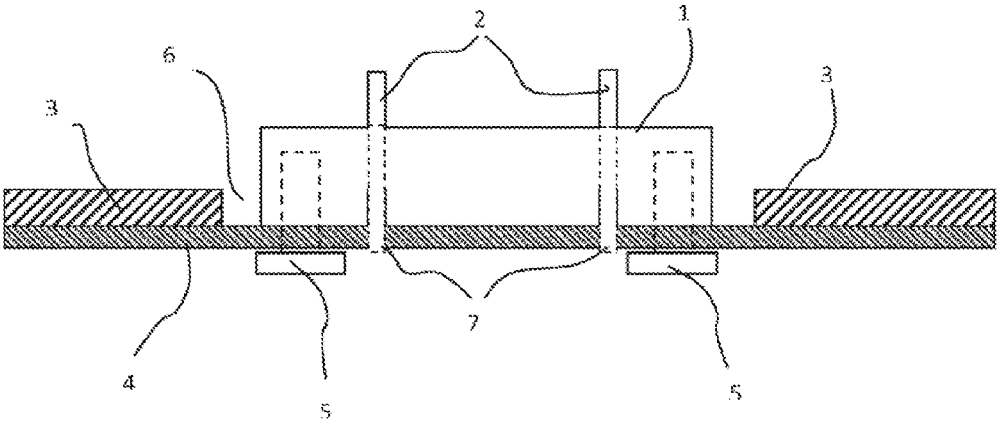
FIG. 1 shows a detail of a known connection between a plug outside a housing and a circuit carrier within the housing.

FIG. 1 shows an electrical connection between a plug 1, which has two plug contacts 2, outside a housing or a housing wall 3 and a circuit carrier 4 which is arranged within the housing. A control unit, in particular comprising heat-generating power components as are used in transmission controllers for motor vehicles, can be arranged on the circuit carrier. The plug 1 is routed through an opening 6 in the housing wall 3 and is in direct contact with the circuit carrier 4 by way of its entire surface area, wherein a respective plug contact 2 is arranged in a corresponding receptacle 7 of the circuit carrier 4 in order to establish the electrical connection. The circuit carrier 4 is connected in a force-locking manner to the plug 1, in particular by means of screws 5.

One disadvantage of this arrangement is that the opening 6 in the housing wall 3 is larger than the plug 1 itself, this, as already mentioned, possibly leading to difficulties when sealing off the plug 1 in relation to the housing wall 3. A further disadvantage with this arrangement is that the dissipation of heat from the circuit carrier 4 to the housing, this being dependent on the contact area between the housing inner wall and the circuit carrier 4, is relatively low.

Furthermore, the size of the circuit carrier 4 depends on the size of the plug 1.

Figure 2:
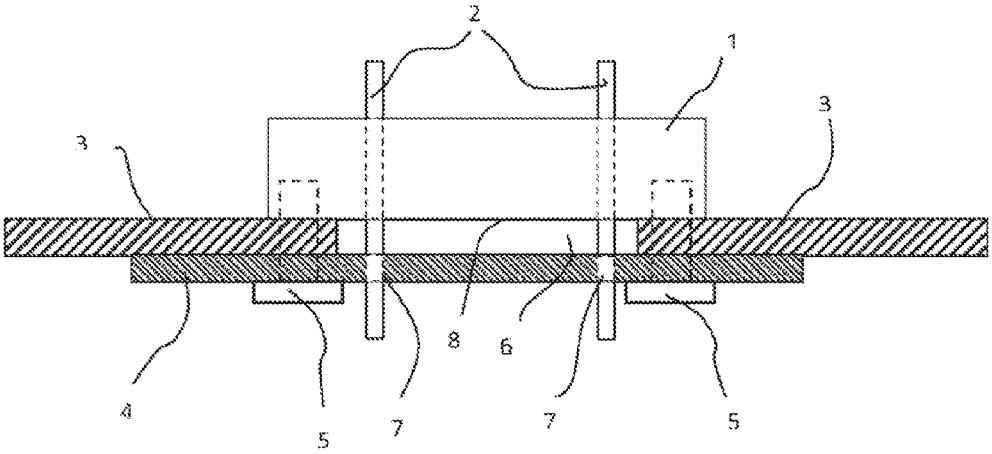
FIG. 2 shows a detail of a connection according to the invention between a plug outside a housing and a circuit carrier within the housing.

FIG. 2 shows an electrical connection according to the invention between a plug 1 of this kind outside the housing and the circuit carrier 4 within the housing, wherein in this case the cross-sectional area of the opening 6 is smaller than the end face 8 of the plug 1 and the plug 1, by way of its end face 8, is arranged on the outside of the housing wall 3 in such a way that the end face 8 completely covers the opening 6.

The circuit carrier 4 is arranged on the inside of the housing wall 3. The larger the contact area between the inside of the housing wall 3 and the circuit carrier 4, the larger the degree of transportation of heat away from the circuit carrier 4 to the housing. In order to establish the electrical connection, two plug contacts 2 protrude through the opening 6 and are each electrically conductively received in a corresponding receptacle 7 of the circuit carrier 4. The number of plug contacts 2 can vary depending on the application.

Since the cross-sectional area of the opening 6 in the housing wall 3 is smaller than the end face 8 of the plug 1, the surface area of the circuit carrier 4 can be correspondingly reduced in comparison to an arrangement as in FIG. 1, in which the plug 1 is directly connected to the circuit carrier 4, this leading to a cost saving, primarily in the case of expensive ceramic circuit carriers. Furthermore, the size of the housing can also be correspondingly reduced in particular.

The circuit carrier 4 is connected in a force-locking manner to the plug 1, in particular by means of screws 5 as the connection element. A form-locking connection, for example by means of a rivet, would also be feasible. In the case of this force-locking connection, the screw 5 is in each case routed through a corresponding cutout in the circuit carrier 4 and in the housing wall 3. The cutout in the housing wall 3 can be completely circumferentially or else only partially closed.

It would also be feasible for the screw 5 to be routed within the opening 6 in the housing wall 3.

The electrical connection between a plug contact 2 and a corresponding receptacle 7 of the circuit carrier 4 can be designed, in particular, as a press-fit connection, wherein the plug contact 2, in a manner which is not illustrated, has a larger diagonal in cross section than the receptacle 7. This results in over-pressing when the plug contact 2 is pressed into the receptacle 7. In this case, the long pin-like plug contacts 2 are free of solder tin and can additionally be used as rear-side contact-making devices. Further advantages of the press-fit technique over the conventional soldering technique have already been described in detail further above.

Figure 3:
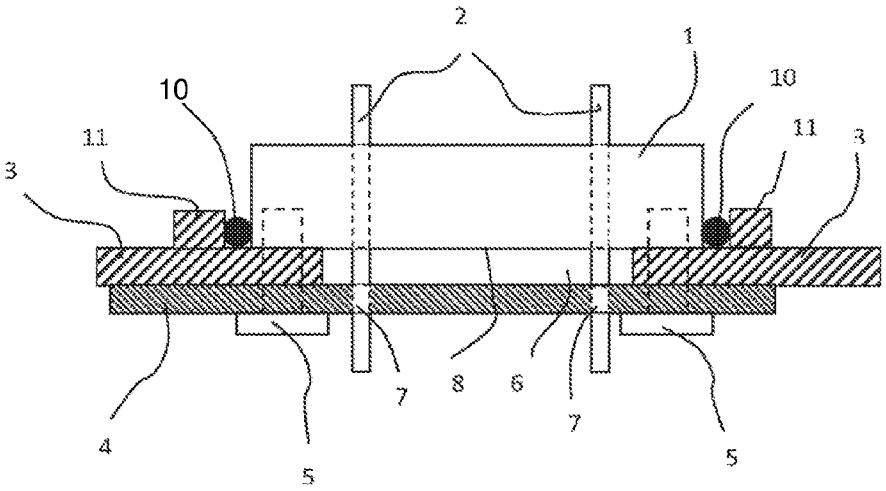
FIG. 3 shows a detail of a connection according to the invention with a radially acting seal between the plug and the housing wall.

FIG. 3 shows a connection according to the invention with a seal 10 which acts radially, in the direction transverse to the longitudinal axis of the plug 1, between the plug 1 and a projection 11, which runs around the opening 6 in the housing wall 3, on the outside of said housing wall. In this case, this projection 11 can be designed as a separate part, as shown in FIG. 3, or, in particular, also can be integrated in the housing wall 3. A feasible seal 10 is a solid seal, for example a seal ring which is composed of plastic, but also a liquid seal.

Figure 4:
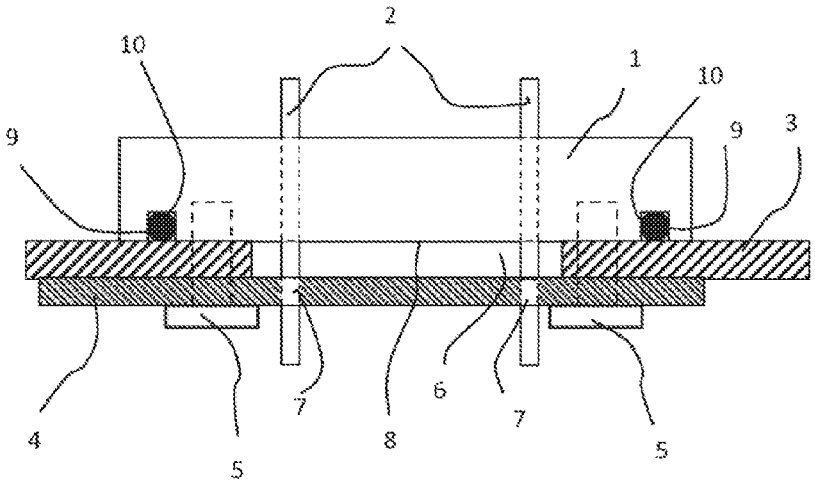
FIG. 4 shows a detail of a connection according to the invention with an axially acting seal between the plug and the housing wall.

FIG. 4 shows a connection according to the invention with a seal 10, which acts axially, in the direction of the longitudinal axis of the plug 1, between the plug 1 and the housing wall 3. In this case, the seal 10 is designed as a seal ring which is arranged in a groove 9 which runs around the end face 8 of the plug 1.

Figure 5:
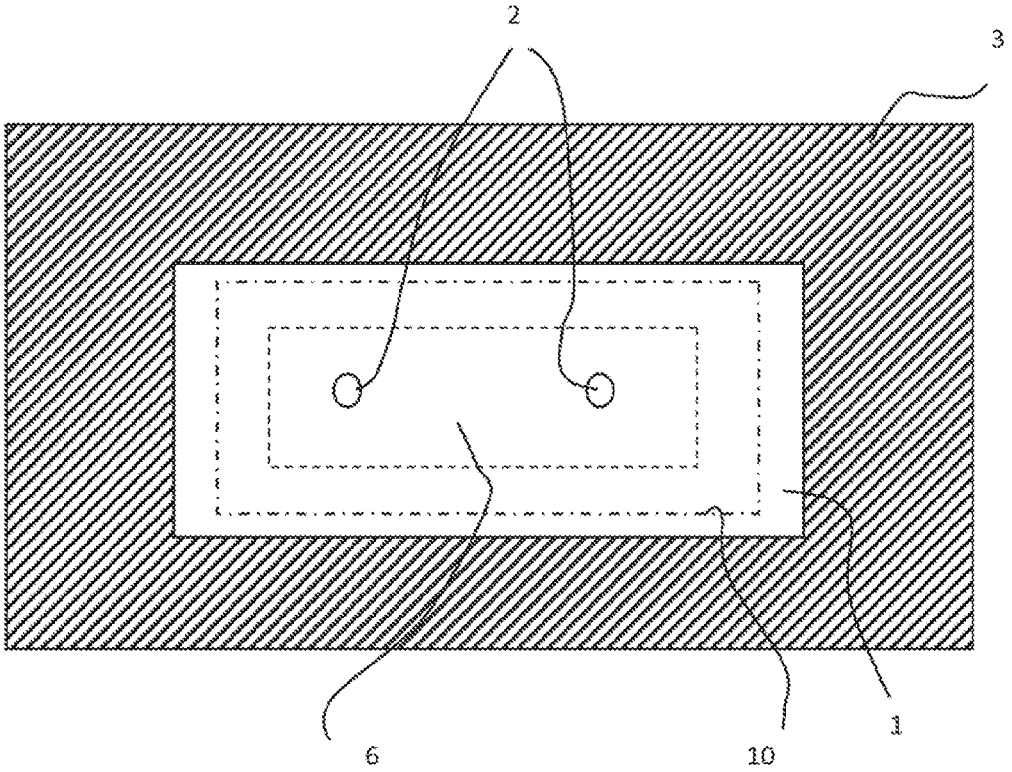
FIG. 5 shows a plan view of a connection according to the invention in accordance with FIG. 4.

FIG. 5 shows a plan view of the connection according to the invention in accordance with FIG. 4 from outside the housing.

LIST OF REFERENCE SYMBOLS

1 Plug
2 Plug contact in the plug
3 Housing wall
4 Circuit carrier
5 Fastening apparatus
6 Opening in the housing wall
7 Receptacle in the circuit carrier
8 End face of the plug
9 Groove in the plug
10 Seal
11 Projection on the outside of the housing wall

The invention claimed is:

1. An electrical connection for a housing having a housing wall, the electrical connection comprising:

a plug disposed outside the housing, said plug including a remote end having an end face directed toward the housing wall and a plurality of plug contacts protruding through an opening in the housing wall in order to establish the electrical connection, said opening having a cross-sectional area being smaller than said end face of said plug, and said end face of said plug completely covering said opening; and a circuit carrier disposed within the housing, said circuit carrier including a plurality of receptacles electrically contacting said plurality of plug contacts of said plug and receiving said plurality of plug contacts of said plug when said plug is connected to said circuit carrier, and said circuit carrier at least partially covering said opening.

2. The electrical connection according to claim 1, which further comprises a seal disposed between said plug and the housing wall.

3. The electrical connection according to claim 2, wherein said seal is disposed axially and acts in a direction of a longitudinal axis of said plug, between said end face of said plug and the housing wall.

4. The electrical connection according to claim 3, wherein said seal is disposed in a groove running around said end face of said plug.

5. The electrical connection according to claim 2, which further comprises a projection running around said opening, said seal being disposed radially and acting in a direction transverse to a longitudinal axis of said plug, between said plug and said projection.

6. The electrical connection according to claim 5, wherein said projection running around said opening is a part of the housing wall.

7. The electrical connection according to claim 1, wherein one of said plurality of plug contacts is connected to one of said plurality of receptacles in said circuit carrier as a press-fit contact.

8. A method for establishing a connection between a plug outside a housing and a circuit carrier within the housing, the method comprising the following steps:

providing the plug with a plurality of plug contacts and with a remote end having an end face, the end face being directed toward a wall of the housing and being larger than a cross-sectional area of an opening in the wall of the housing;

providing the circuit carrier with a plurality of receptacles;

positioning the circuit carrier on an inside of the housing wall with the circuit carrier at least partially covering the opening in the housing wall;

positioning the plug on an outside of the housing wall with the end face completely extending over a width and a length of the opening and simultaneously inserting the plurality of plug contacts of the plug through the opening and into the plurality of receptacles in the circuit carrier to establish electrical connections between the plurality of plug contacts of the plug and the plurality of receptacles in the circuit carrier; and establishing a force-locking or form-locking connection between the circuit carrier and the plug outside the opening having the at least one plug contact protruding therethrough.

9. A transmission controller for a motor vehicle, the transmission controller comprising the electrical connection according to claim 1.

10. The electrical connection according to claim 1, wherein said circuit carrier is connected to said plug in a force-locking manner or a form-locking manner outside said opening having said plurality of plug contacts protruding therethrough.

* * * * *